US008197309B2

(12) United States Patent
Lee

(10) Patent No.: US 8,197,309 B2
(45) Date of Patent: Jun. 12, 2012

(54) GRINDING WHEEL ASSEMBLY

(76) Inventor: Chung-Han Lee, Taichung (TW)

( * ) Notice: Subject to any disclaimer, the term of this patent is extended or adjusted under 35 U.S.C. 154(b) by 554 days.

(21) Appl. No.: 12/507,104

(22) Filed: Jul. 22, 2009

(65) Prior Publication Data

US 2011/0021119 A1 Jan. 27, 2011

(51) Int. Cl.
*B24B 23/02* (2006.01)

(52) U.S. Cl. ..... 451/342; 451/358

(58) Field of Classification Search ..... 451/342, 451/359, 344, 358
See application file for complete search history.

(56) References Cited

U.S. PATENT DOCUMENTS 7,144,315 B1 * 12/2006 Sun et al. ..... 451/541
7,147,550 B2 * 12/2006 Chen ..... 451/520
7,465,222 B1 * 12/2008 Sun et al. ..... 451/342
7,578,730 B2 * 8/2009 Chen ..... 451/466
7,904,989 B1 * 3/2011 Chen ..... 15/230.16
8,007,347 B1 * 8/2011 Lampka et al. ..... 451/358

* cited by examiner

*Primary Examiner* — Robert Rose

(57) ABSTRACT

The present invention discloses a grinding wheel assembly including a coupling member, two clamping disks and a grinding wheel. There is a plurality of bulged anchor rims around the coupling member. On both sides of the coupling member, there are two hollow ducts which are linked through a first shaft duct in the center and surrounded by a plurality of laterally penetrated ventilation openings. Two clamping disks are symmetrically mounted onto the grinding wheel. On one side of each clamping disk are anchor troughs, ventilation holes, cylinders and shaft ducts, and on the other side is a polygonal trough. There are cogs around the grinding wheel and there are clamping troughs and a plurality of mounting troughs on each side of the grinding wheel. In the center of the grinding wheel is a coupling opening whose inner wall has a plurality of concaved anchor openings. From above interrelated mechanical design, it tends to make the coupling member, two clamping disks and the grinding wheel tightly anchor with each other, so that the object of being installed or uninstalled easily, being steadily structured and being used for longer life time can be achieved.

10 Claims, 10 Drawing Sheets

GRINDING WHEEL ASSEMBLY

FIELD OF THE INVENTION

The present invention relates to a grinding wheel assembly for grinding wheels and particularly to a grinding wheel assembly consolidating a grinding wheel with a coupling member and two clamping disks. It improves the convenience of its assembly and the steadiness and strength of its consolidation as well, and is easier for the grinding wheel to be reversibly replaced to extend its durability.

BACKGROUND OF THE INVENTION

According to the prior art of a grinding wheel assembly disclosed in the FIGS. 4 and 5 of U.S. Pat. No. 7,147,550, the grinding wheel assembly, adopted for use on pneumatic tools, includes two clamping disks, a grinding wheel and a fastening element. The first clamping disk has a plurality of first anchor plates and a plurality of first anchor slots on one side. The first anchor plates and the first anchor slots are located on different perimeters in an alternate manner. The second clamping disk has a plurality of second anchor plates and a plurality of second anchor slots on one side. The second anchor plates and the second anchor slots are located on different perimeters in an alternate manner. The first anchor plates correspond to the second anchor slots. The second anchor plates correspond to the first anchor slots. The first anchor plates and the second anchor plates can be wedged respectively in the second anchor slots and the first anchor slots so that the first clamping disk and the second clamping disk form a mechanical interference with each other to achieve an anchoring effect. A fastening element is provided to run through the first hollow duct and the second hollow duct to fasten the grinding wheel to a pneumatic tool.

Somehow, there are following certain disadvantages from the prior grinding wheel assembly mentioned above:

1. The first anchor plates 110 of the first clamping disk 100 are inserted into troughs 310 formed on the grinding wheel 300, and the second anchor plates 210 of the second clamping disk 200 are inserted into a round opening 320 formed in the center of the grinding wheel 300. Apparently, there is no mechanical interference between the second clamping disk 200 and the grinding wheel 300 so that the structural strength of the grinding wheel assembly is weak.

2. The ventilation is poor due to lack of ventilators between the clamping disks 100/200 and the grinding wheel 300. When the pneumatic tool drives the grinding wheel 300 to rotate too long, the overall structure of the grinding wheel assembly is prone to be overheated because of the insufficient air circulation within the grinding wheel 300.

3. The coupling head of the pneumatic tool can only be fastened onto one side of the first clamping disk 100. When the grinding wheel 300 rotates for a long period of time, its outward wheel will be worn out more than the other side, causing the unbalance of the wheel and affecting the stability while rotating.

4. The clamping disks 100/200 can only fit onto one size of the grinding wheel 300. When the grinding wheel 300 needs changing to different size, it increases the cost to change the clamping disks 100/200 as well.

SUMMARY OF THE INVENTION

The primary object of the present invention is to provide a grinding wheel assembly that is an easy to install or uninstall, steady structured and longer life time tool. In order to achieve the foregoing object, the grinding wheel assembly of the present invention includes a coupling member, two clamping disks and a grinding wheel. There is a plurality of bulged anchor rims around the coupling member. On both sides of the coupling member, there are two hollow ducts which are linked through a first shaft duct in the center and surrounded by a plurality of laterally penetrated ventilation openings. Two clamping disks are symmetrically mounted onto the grinding wheel. On one side of each clamping disk are anchor troughs, ventilation holes, cylinders and shaft ducts, and on the other side is a polygonal trough. There are cogs around the grinding wheel and there are clamping troughs and a plurality of mounting troughs on each side of the grinding wheel. In the center of the grinding wheel is a coupling opening whose inner wall has a plurality of concaved anchor openings. From above interrelated mechanical design, it tends to make the coupling member, the two clamping disks and the grinding wheel tightly anchor with each other, so that the object of the present invention can be achieved.

DETAILED DESCRIPTION OF THE PREFERRED EMBODIMENT

Figure 1:
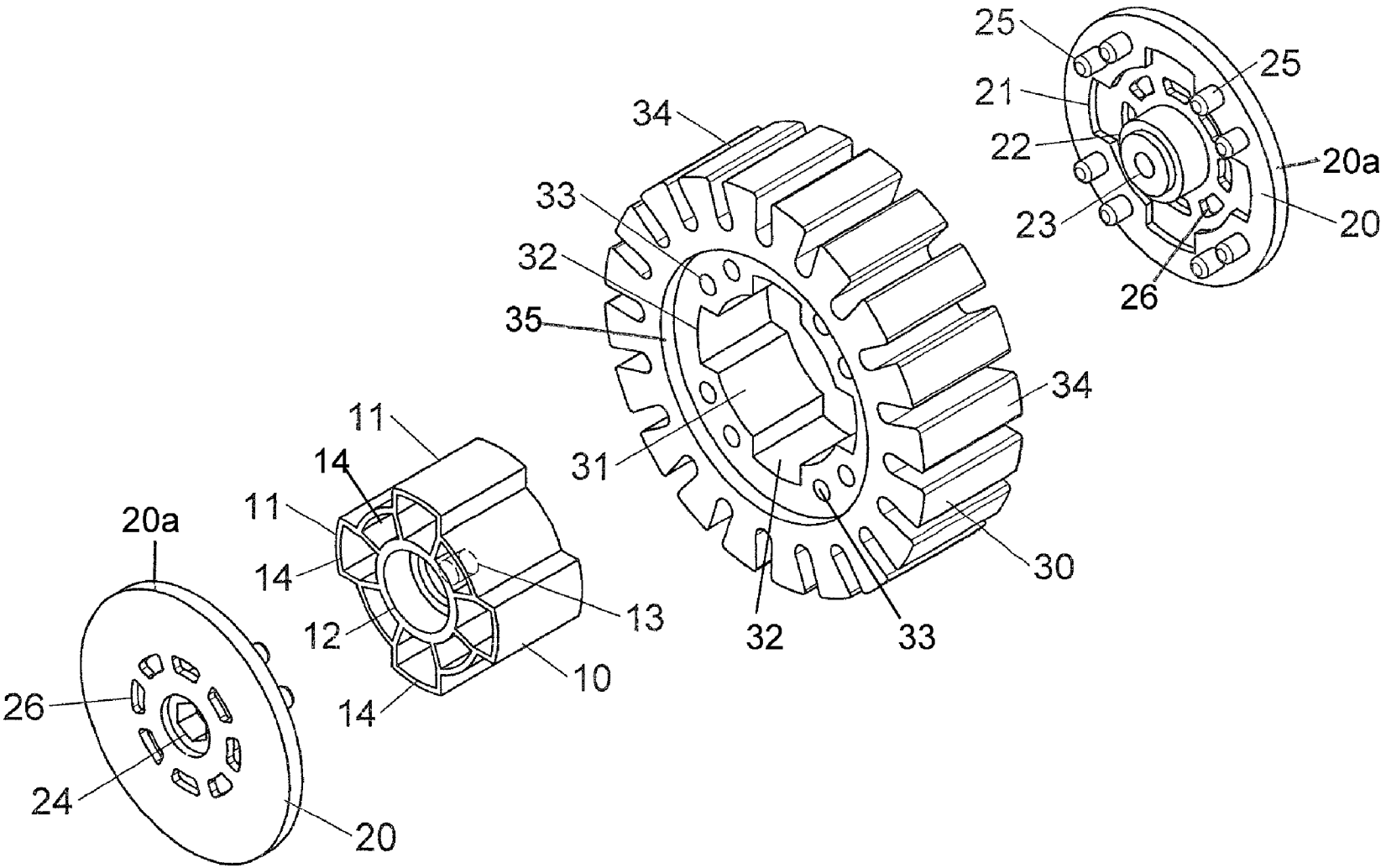
FIG. 1 is an exploded perspective view of the grinding wheel assembly of the present invention.
Figure 6:
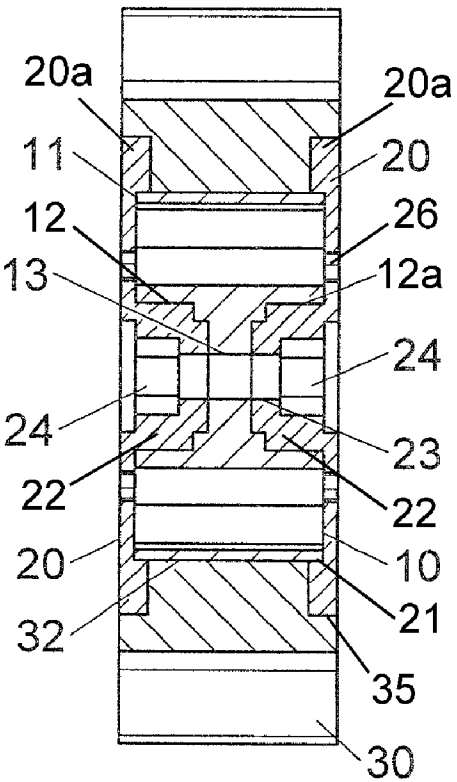
FIG. 6 is a cross sectional view, taken along line A-A in FIG. 5.

Referring to FIGS. 1 and 6, the grinding wheel assembly of the present invention designed for use of surface treatment includes a coupling member 10, two symmetrical clamping disks 20 and a grinding wheel 30. The structure of above components is detailed as bellow:

The coupling member 10 has opposite a front end and a rear end, and a first central axial line is extending through both ends. There is a plurality of bulged anchor rims 11 symmetrically provided on the periphery of the coupling member and encircling around the first central axial line of the coupling member. The number of the anchor rims 11 demonstrated in the drawings is four, and two opposite edges of the rims are parallel to each other. In the center of the coupling member 10 are round hollow ducts 12,12*a* formed on the front end and the rear end each, and along the first central axial line is a first shaft duct 13 whose diameter is less than those of hollow ducts 12,12*a*. The hollow ducts 12,12*a* of both ends are linked to each other through the first shaft duct 13, and the coupling member 10 is also surrounded by a plurality of longitudinally penetrated ventilation openings 14 being parallel with the first central axial line. The coupling member 10 can be fabricated by extruding aluminum into a long narrow strip, cutting into designed length, and then lathing out the hollow ducts 12,12*a*.

The two symmetrical clamping disks 20 are the same structure and shape with each other. Each of the two symmetrical clamping disks 20 has a disk 20*a* whose first surface has a concaved anchor trough 21. The outline shape of the anchor trough 21 matches to both ends of the coupling member 10, so the ends of the coupling member 10 can be anchored onto the troughs 21. Shown as the drawing, the depth of the anchor trough 21 is half of the thickness of the disk 20*a* of the clamping disk 20. Furthermore, in the center of the anchor trough 21 of each clamping disk 20 is a protruding cylinder 22 whose outer diameter matches to the diameters of the hollow ducts 12,12*a* of the coupling member 10. The cylinders 22 of the two clamping disks 20 can be inserted into the hollow ducts 12,12*a*, and in the center of a distal end of the protruding cylinders 22 of the two clamping disks 20 is a second shaft duct 23 longitudinally extended and corresponded to the first shaft duct 13. On the disk 20*a* of the clamping disk 20, the opposite side of the first surface is a second surface whose center has a polygonal trough 24, particularly a hexagon trough 24 shown in the embodiment of drawing, interlinked with the second shaft duct 23. In addition, there is a plurality of protruding rods 25 formed on the first surface of the disk 20*a* and distributed around the contour of the anchor trough 21. There is also a plurality of penetrating ventilation holes 26 drilled on the bottom of the anchor trough 21 and around the central cylinder 22 of the disk 20*a*. Each ventilation hole 26 corresponds with a ventilation opening 14 of the coupling member 10.

The grinding wheel 30 has opposite one front end and one rear end, and a second central axial line is extending through both ends. There is a clamping trough 35 on each of the ends, and the diameter of the clamping trough 35 matches to the diameter of the disk 20*a* of the clamping disk 20, so the disk 20 can be mounted into the clamping trough 35. In the center of the grinding wheel 30 is a coupling opening 31 extended along the second central axial line. On the inner wall of the coupling opening 31 is a plurality of concaved anchor openings 32 encircling around the second central axial line, and the interior contour of the coupling opening 31 exactly corresponds to the outline shape of the coupling member 10. When the coupling member 10 is inserted into the coupling opening 31, the anchor rims 11 are anchored within the anchor openings 32. Furthermore, on the bottom of each clamping trough 35 is a plurality of mounting troughs 33. The diameter of the mounting trough 33 matches to the outer diameter of the protruding rod 25 of the clamping disk 20, so the protruding rods 25 can be mounted into the mounting troughs 33. There is a plurality of cogs 34 encircled around the periphery of the grinding wheel 30, and each cog 34, viewed from the cross sectional view, has a wider top than its bottom. When a pneumatic tool drives the grinding wheel 30 to rotate, the cogs 34 can be spun with a high speed to result friction with a workpiece and to remove the stain, such as viscose, from the surface of the workpiece.

Figure 2:
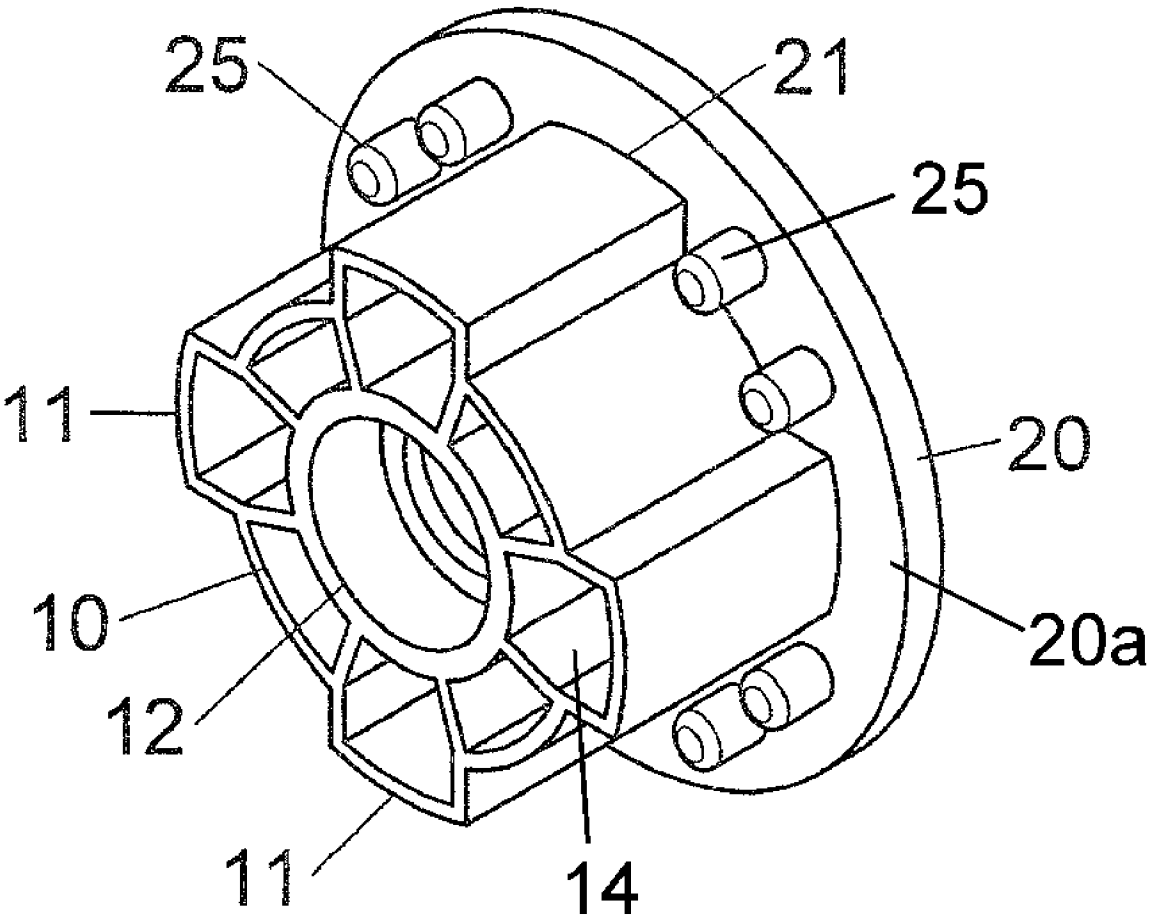
FIG. 2 is a schematic drawing of the part of the present invention.
Figure 3:
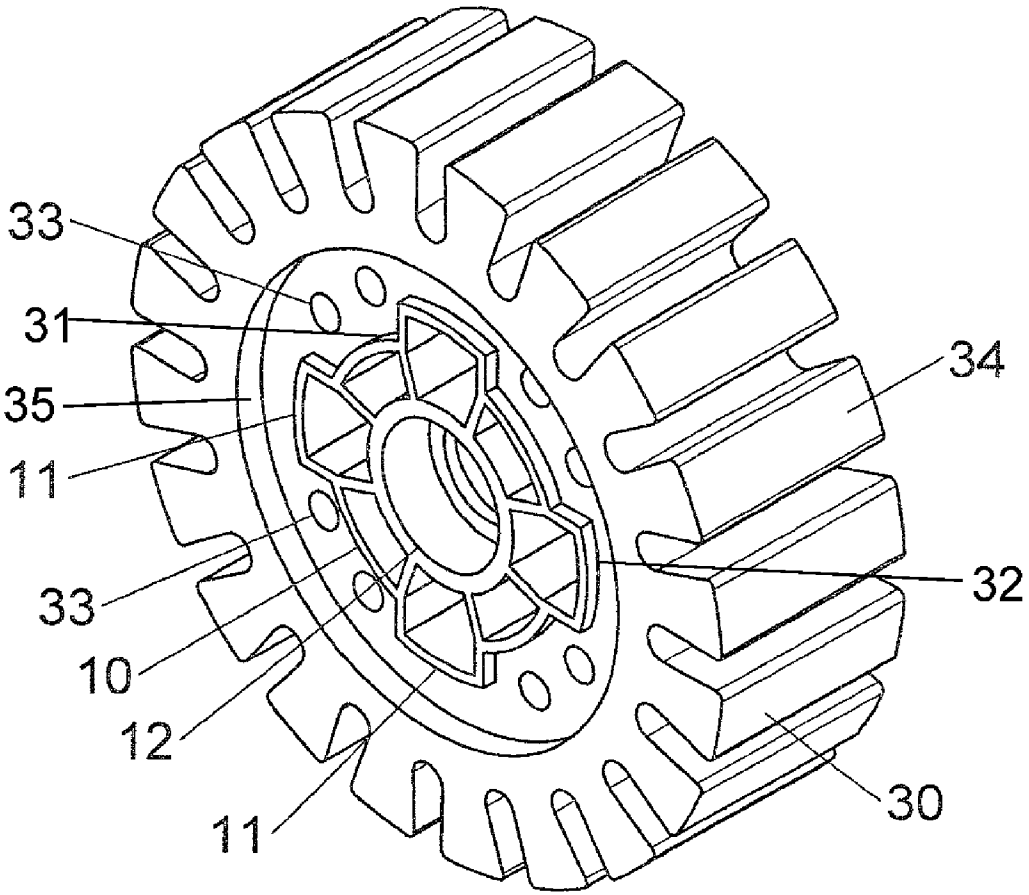
FIG. 3 is a schematic drawing of the part of the present invention.
Figure 4:
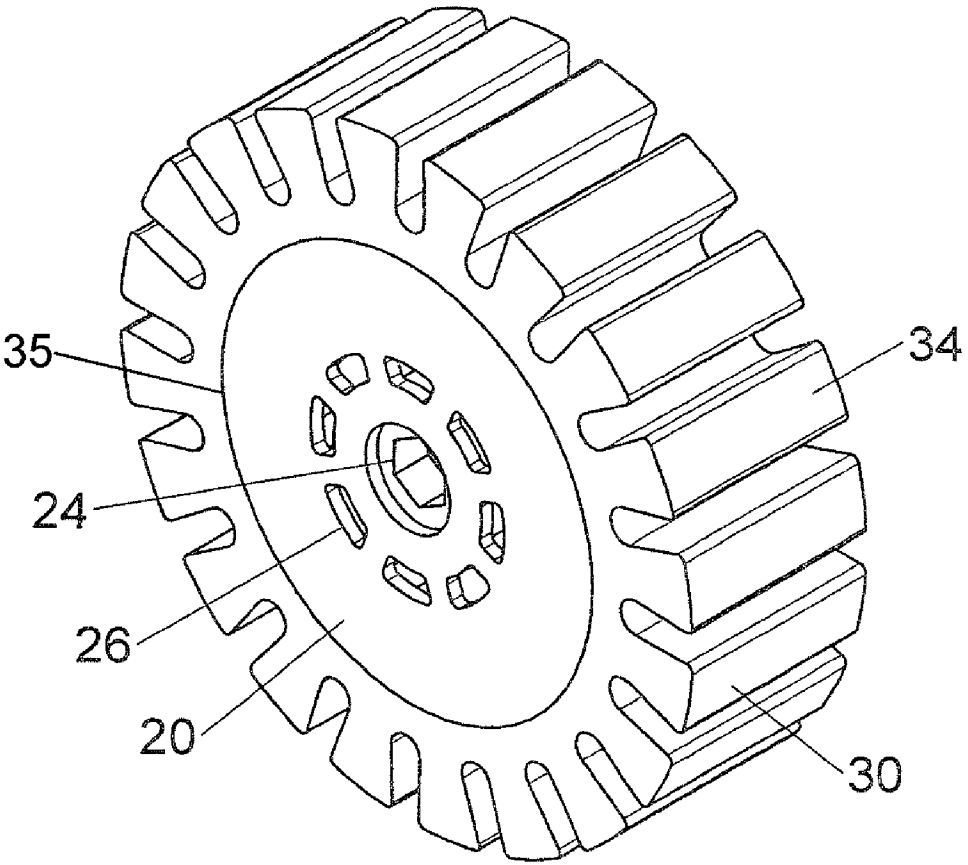
FIG. 4 is an appearance drawing of the assembled grinding wheel assembly of the present invention.

Referring to FIGS. 1 to 6, the present invention is assembled by first anchoring the rear end of the coupling member 10 onto the anchor trough 21 of the first clamping disk 20 and inserting the cylinder 22 into the hollow duct 12*a* on the rear end of the coupling member 10 shown as FIG. 2; next, inserting the front end of the coupling member 10 through the coupling opening 31 of the grinding wheel 30, clamping the disk 20*a* into the clamping trough 35 on the rear end of the grinding wheel 30, and mounting the protruding rods 25 into the mounting troughs 33 on the rear end of the grinding wheel 30 shown as FIG. 3; and then, clamping the disk 20*a* of the second clamping disk 20 into the clamping trough 35 on the front end of the grinding wheel 30, anchoring the front end of the coupling member 10 into the anchor trough 21 of the second clamping disk 20, inserting the cylinder 22 into the hollow duct 12 on the front end of the coupling member 10, and mounting the protruding rods 25 into the mounting troughs 33 on the front end of the grinding wheel 30 shown as FIG. 4. After assembly, the two clamping disks 20 are at the same level with both ends of the grinding wheel 30, and the position of the ventilation holes 26 are aligned and interlinked with the ventilation openings 14. When a pneumatic tool drives the grinding wheel 30 to rotate, the ventilation holes 26 and the ventilation openings 14 are able to provide sufficient air circulation and to cool down the wheel efficiently.

Figure 5:
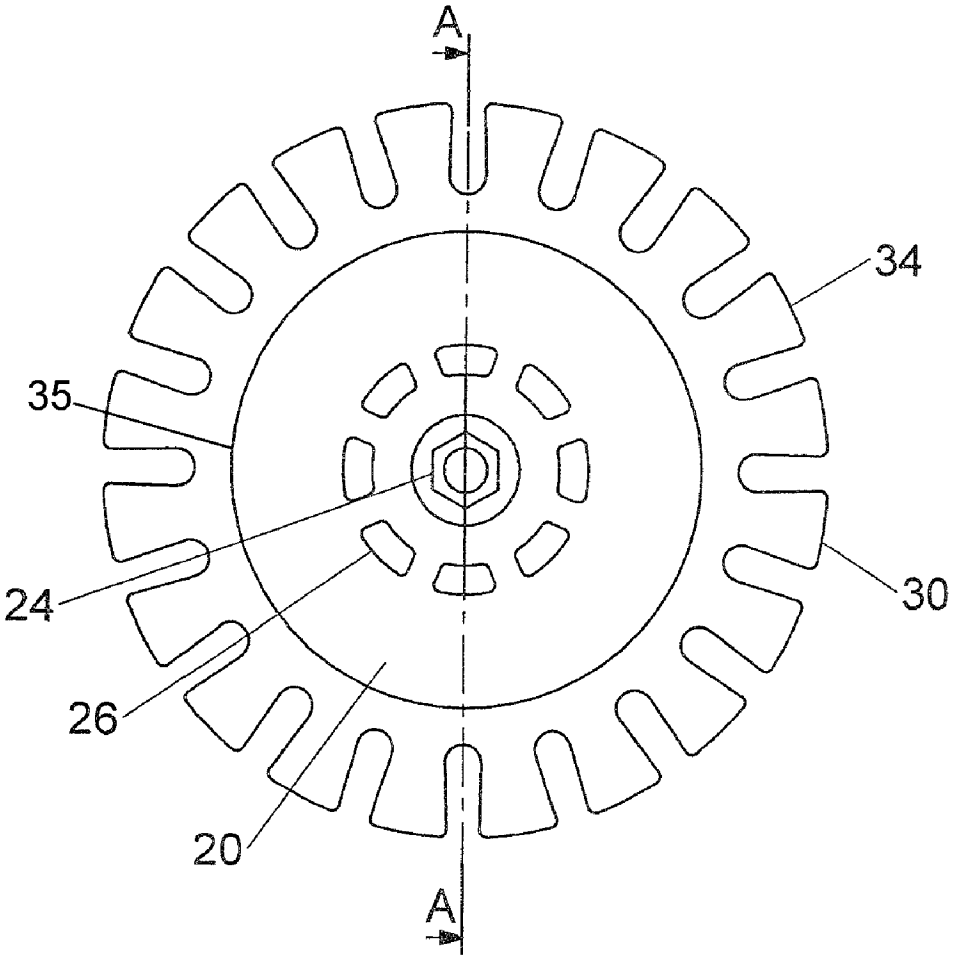
FIG. 5 is a front view of the present invention.

Referring to FIGS. 5 and 6, both ends of the coupling member 10 are anchored by the anchor troughs 21 of the clamping disks 20; the hollow ducts 12, 12*a* are inserted by the cylinders 22; the coupling member 10 is tightly clamped by the clamping disks 20; the coupling member 10 is coupled with the corresponding contour of the coupling opening 31 of the grinding wheel 30 so as to tightly integrate the coupling member 10 and the grinding wheel 30, and the protruding rods 25 are mounted into the mounting troughs 33 so that the clamping disks 20 and the grinding wheel 30 are also tightly integrated. Therefore, the coupling member 10, the two clamping disks 20 and the grinding wheel 30 are firmly integrated as a solid structure.

Figure 7:
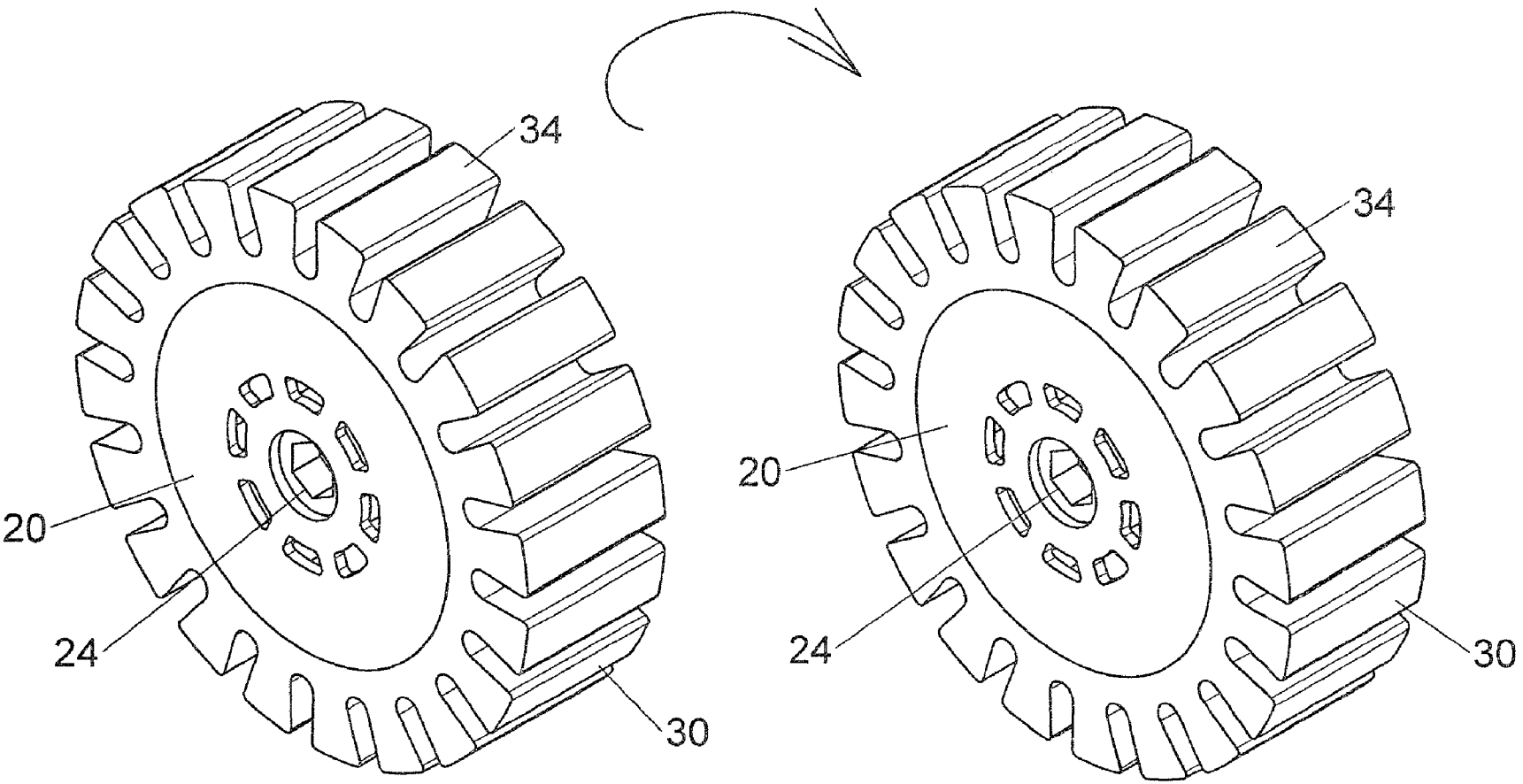
FIG. 7 is schematic drawings to show the movement of the present invention.

Referring to FIG. 7, a regular pneumatic tool has a protruded fastening element which is inserted into shaft ducts 13, 23 and its bolt is located within the polygonal trough 24. After the fastening element is fastened to the bolt, the pneumatic tool can be activated to drive the grinding wheel assembly. When the grinding wheel 30 is used for a long period of time, its outward wheel will be worn out more than the other side. The present invention has two symmetrical clamping disks 20 on both sides of the grinding wheel 30, and that allows to detach the fastening element from the grinding wheel 30 and to reverse the grinding wheel 30 before fastening the fastening element to the grinding wheel 30 again. By doing so, the less worn-out end of the grinding wheel can be carried on to grind other workpieces. Consequently, not only can the wheel be replaced easily, but also can avoid reducing the grinding quality and increasing the noise due to the unbalanced surface of cogs.

Figure 9:
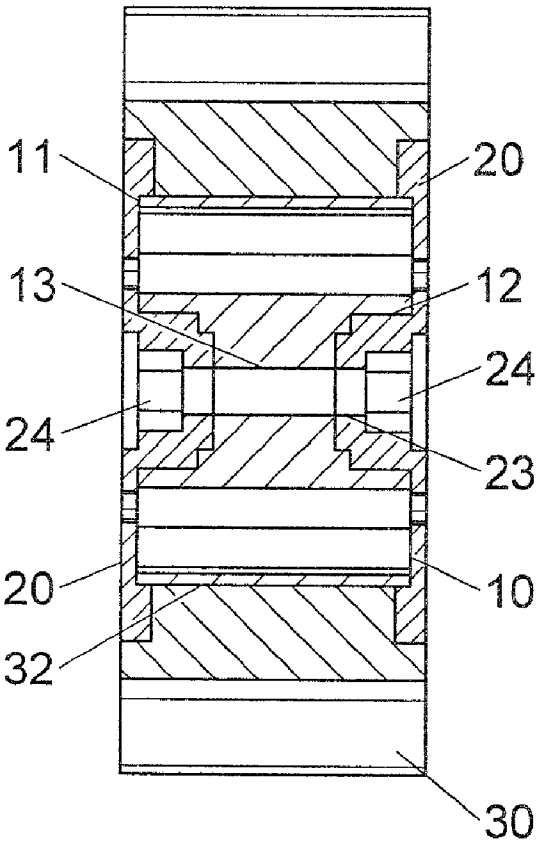
FIG. 9 is a cross sectional view to show the second embodiment of the present invention.
Figure 8:
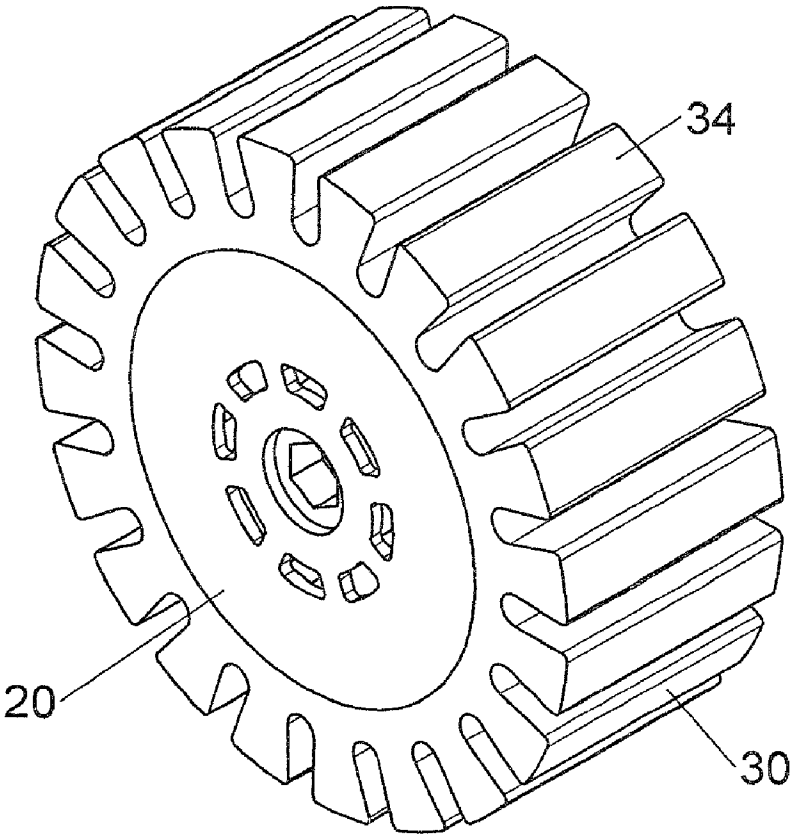
FIG. 8 is a perspective appearance drawing to show the second embodiment of the present invention.

Referring to FIGS. 8 and 9, in the second embodiment of the present invention, the thickness of the coupling member 10 can be changed in accordance with the thickness of the grinding wheel 30. What users need to do is to change the coupling member 10 and integrate the original two clamping disks 20 with the coupling member 10 and the grinding wheel 30. The present invention is capable of adapting various coupling member 10 with different length for various sizes of the grinding wheel 30, and the coupling member 10 can be fabricated by extruding aluminum into a long narrow strip and cutting into pre-designed length to match the thickness of the grinding wheel 30.

Figure 10:
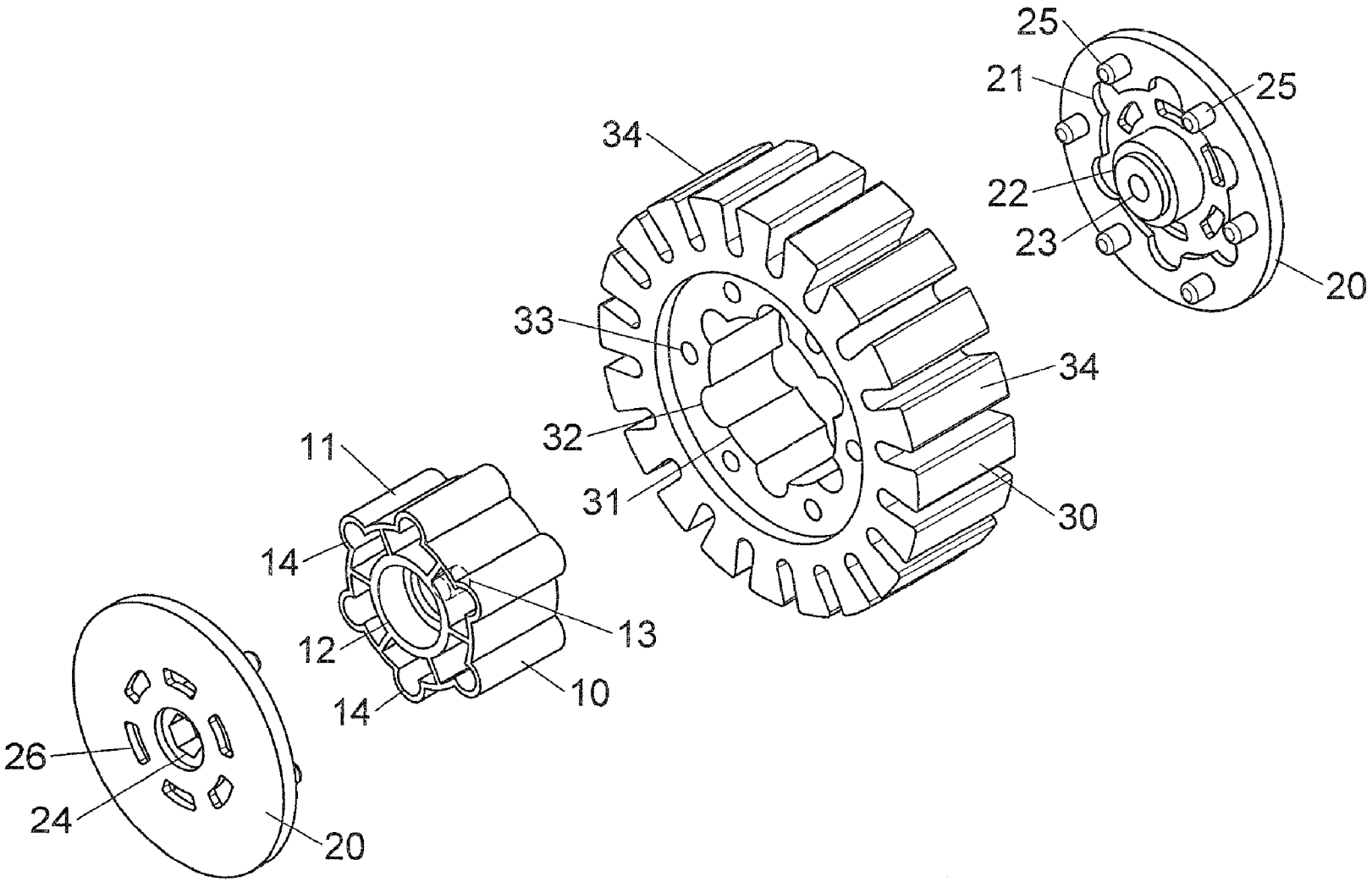
FIG. 10 is an exploded perspective view to show the third embodiment of the present invention.

Referring to FIG. 10, in the third embodiment of the present invention, the distal edge of each anchor rims 11 of the coupling member 10 is designed as arc shaped surfaces, and the clamping disks 20, the anchor troughs 21 and the contour of the coupling opening 31 of the grinding wheel 30 are all designed to match them, so it can be smoother while assembling.

Figure 11:
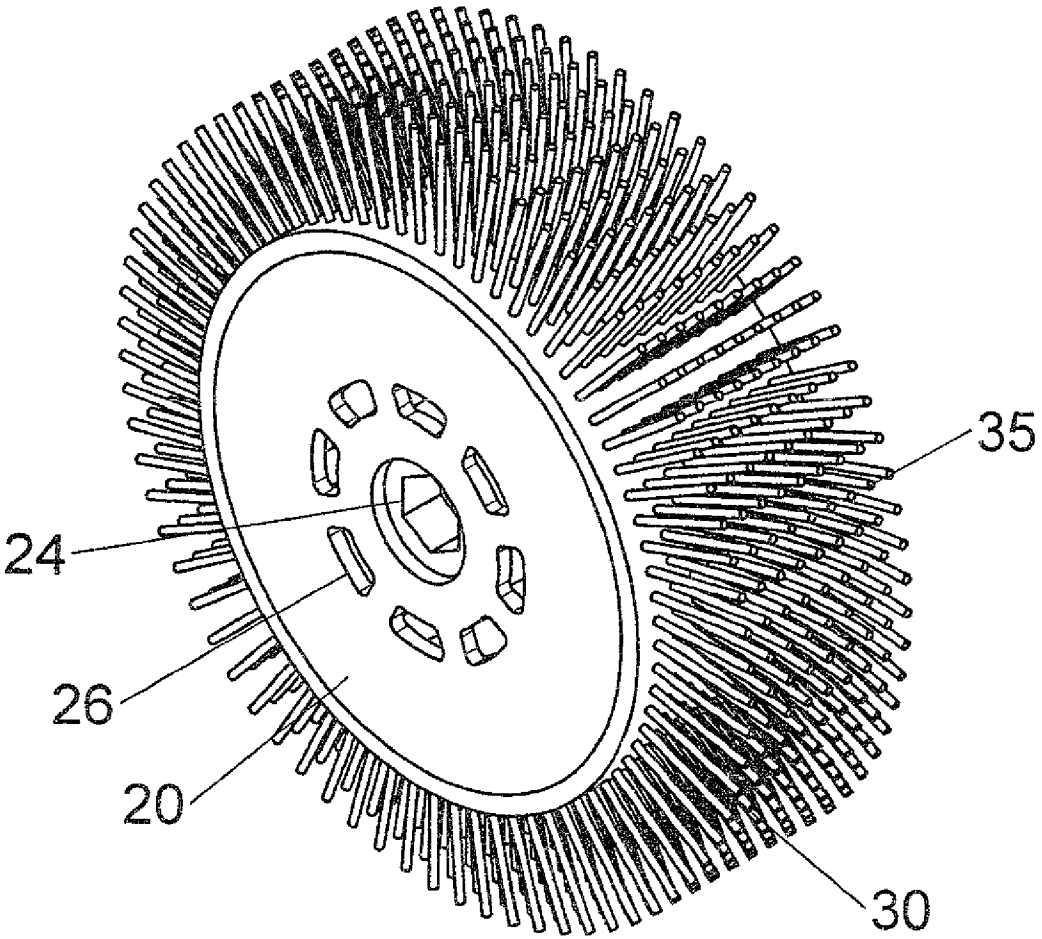
FIG. 11 is a perspective appearance drawing to show the fourth embodiment of the present invention.

Referring to FIG. 11, in the fourth embodiment of the present invention, the grinding wheel 30 can be a steel brush 35. There are steel brushes shaped like needles extended radially and around the periphery of the grinding wheel 30. When the grinding wheel 30 is fast rotated, the steel brush will be working on the surface of the workpiece.

Figure 12:
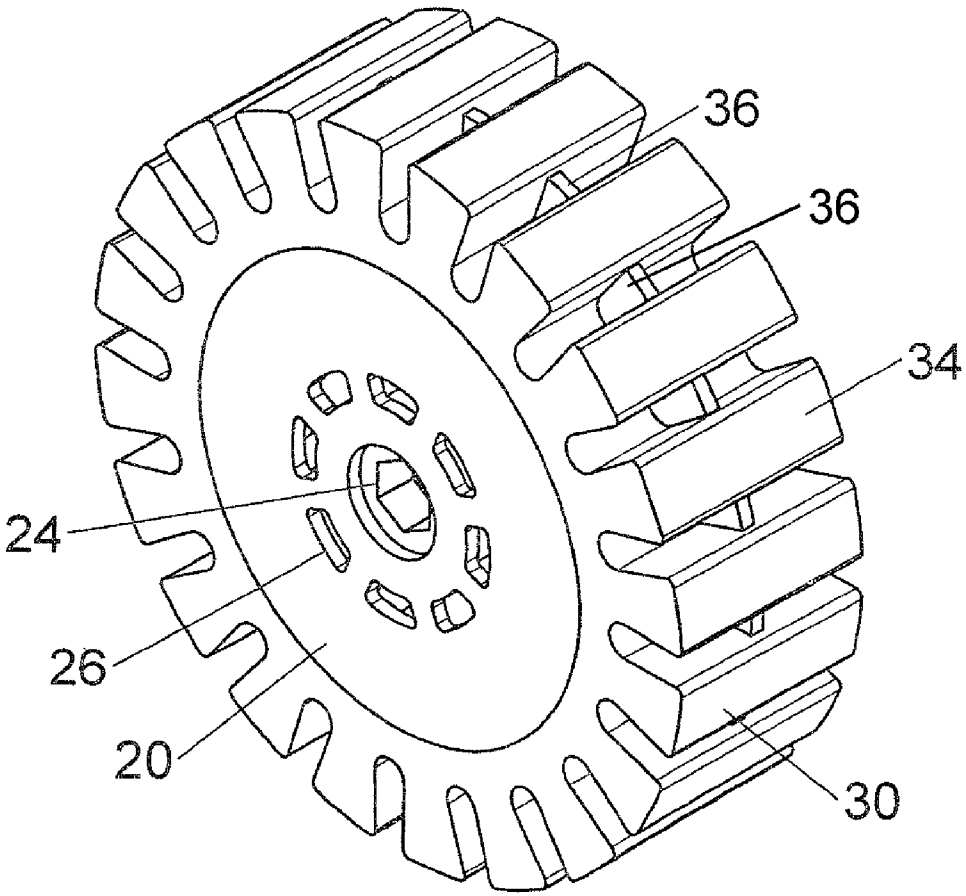
FIG. 12 is a perspective appearance drawing to show the fifth embodiment of the present invention.

Referring to FIG. 12, in the fifth embodiment of the present invention, between each two adjacent cogs 34 of the grinding wheel 30 is a thin brace 36 which connects the two cogs 34 to enhance the structural strength of the grinding wheel 30.

The advantages of the present invention are:

1. The coupling member 10, the two clamping disks 20 and the grinding wheel 30 are firmly integrated as a solid structure. The design of such integration enhances the strength of the structure and makes components link with each other much tighter.

2. The ventilation holes 26 of the clamping disks 20 are aligned and interlinked with the ventilation openings 14 of the coupling member 10. When a pneumatic tool drives the grinding wheel 30 to rotate, the ventilation holes 26 and the ventilation openings 14 are able to provide sufficient air circulation and to cool down the wheel efficiently, so the grinding wheel assembly can be more durable.

3. There are two symmetrical clamping disks 20 with the same design on both sides of the grinding wheel 30, and that allows the grinding wheel 30 to be reversed and attached back to the pneumatic tool again when one end of the grinding wheel 30 is worn out. Not only can the wheel be functioned more stable, but also can extend its durability and reduce the noise.

4. The length of the coupling member 10 can be varied to fit the size of the grinding wheel 30, and the two clamping disks 20 can be applied to any size of the coupling member 10 and the grinding wheel 30. It can lower the cost of the clamping disk.

While we have shown and described the embodiment in accordance with the present invention, it should be clear to those skilled in the art that further embodiments may be made without departing from the scope of the present invention.

What is claimed is:

1. A grinding wheel assembly ' comprising:

a coupling member having opposite a front end and a rear end, and a first central axial line extending through both said ends, a plurality of bulged anchor rims provided on the periphery of the coupling member and encircling around the first central axial line of the coupling member, the center of the coupling member having round hollow ducts formed on the front end and the rear end each, along the first central axial line being a first shaft duct whose diameter is less than those of hollow ducts, the first shaft duct linking through both hollow ducts, and the coupling member being surrounded by a plurality of longitudinally penetrated ventilation openings parallel with the first central axial line;

two symmetrical clamping disks having a disk each, the first surface of each disk having a concaved anchor trough whose contour matches to the front end and rear end of the coupling member which can be anchored onto the troughs of both said clamping disks, the center of the anchor trough of each clamping disk having a cylinder whose outer diameter matches to the hollow ducts' diameter of the coupling member, the cylinders of the two clamping disks being inserted into the hollow ducts respectively, the center of the cylinders on both clamping disks having a second shaft duct longitudinally extended and corresponded to the first shaft duct, the opposite side of the first surface on each disk having a second surface whose center has a polygonal trough which is interlinked with the second shaft duct, a plurality of protruding rods being formed on the first surface and distributed around the contour of the anchor trough, a plurality of penetrating ventilation holes being drilled on the bottom of the anchor trough and around the central cylinder of the disk, and each penetrating ventilation hole corresponding with a ventilation opening of the coupling member; and a grinding wheel having a front end, a rear end and a second central axial line extending through both said ends, each end having a clamping trough whose diameter matches to the diameter of the disk and enables the disk to be mounted into the clamping trough, the center of the grinding wheel having a coupling opening extending along the second central axial line, the inner wall of the coupling opening having a plurality of concaved anchor openings encircling around the second central axial line, the interior contour of the coupling opening exactly corresponding to the outline shape of the coupling member, the anchor rims being anchored within the anchor openings when the coupling member being inserted into the coupling opening, the bottom of each clamping trough having a plurality of mounting troughs whose diameter matches to the outer diameter of the protruding rod of the clamping disk and enables the protruding rods to be mounted into the mounting troughs, and a plurality of cogs encircling around the grinding wheel.

2. The grinding wheel assembly as claimed in claim 1, wherein the number of anchor rims is four.

3. The grinding wheel assembly as claimed in claim 1, wherein anchor rims are symmetrically provided on the periphery of the coupling member and around the first central axial line, and two opposite edges of each anchor rim are parallel to each other.

4. The grinding wheel assembly as claimed in claim 1, wherein a coupling member is made of aluminum by extruding and cutting into a pre-designed length.

5. The grinding wheel assembly as claimed in claim 1, wherein each cog viewed from the cross sectional view, has a wider top than its bottom.

6. The grinding wheel assembly as claimed in claim 1, wherein a distal edge of each anchor rims of the coupling member is an arc shaped surface.

7. The grinding wheel assembly as claimed in claim 1, wherein the periphery of the grinding wheel provided a plurality of needle shaped steel brushes around.

8. The grinding wheel assembly as claimed in claim 1, wherein between each two adjacent cogs of the grinding wheel is supported by a thin brace.

9. The grinding wheel assembly as claimed in claim 1, wherein the depth of an anchor trough is half thickness of the disk.

10. The grinding wheel assembly as claimed in claim 1, wherein The two symmetrical clamping disks are the same structure and shape with each other.

* * * * *